US010822913B2

(12) United States Patent
Zhang et al.

(10) Patent No.: US 10,822,913 B2
(45) Date of Patent: Nov. 3, 2020

(54) ENERGY-GATHERED BUNDLE TYPE NESTING PLUGGING AND WALL REINFORCING DEVICE AND APPLICATION THEREOF IN KARST CAVE PLUGGING

(71) Applicant: China University of Petroleum—Beijing, Beijing (CN)

(72) Inventors: Yiqun Zhang, Beijing (CN); Ya Liu, Beijing (CN); Gensheng Li, Beijing (CN); Zhongwei Huang, Beijing (CN); Huaizhong Shi, Beijing (CN); Xianzhi Song, Beijing (CN); Mao Sheng, Beijing (CN); Lu Ji, Beijing (CN)

(73) Assignee: China University of Petroleum-Beijing, Beijing (CN)

( * ) Notice: Subject to any disclaimer, the term of this patent is extended or adjusted under 35 U.S.C. 154(b) by 75 days.

(21) Appl. No.: 16/242,099

(22) Filed: Jan. 8, 2019

(65) Prior Publication Data

US 2019/0153809 A1 May 23, 2019

Related U.S. Application Data

(63) Continuation of application No. PCT/CN2017/089096, filed on Jun. 20, 2017.

(30) Foreign Application Priority Data

Feb. 15, 2017 (CN) ..... 2017 1 0081098

(51) Int. Cl.

| | |
|---|---|
| ***E21B 33/13*** | (2006.01) |
| ***E21B 29/02*** | (2006.01) |
| ***F42D 3/00*** | (2006.01) |

(52) U.S. Cl.

CPC ..... *E21B 33/13* (2013.01); *E21B 29/02* (2013.01); *F42D 3/00* (2013.01)

(58) Field of Classification Search

CPC ..... E21B 33/10; E21B 33/13; E21B 33/138; E21B 29/02

See application file for complete search history.

(56) References Cited

U.S. PATENT DOCUMENTS 5,564,499 A 10/1996 Willis et al.
5,613,557 A * 3/1997 Blount ..... E21B 23/06 166/277
2015/0361759 A1 12/2015 Kjorholt et al.

FOREIGN PATENT DOCUMENTS

CN 86105631 A 2/1987
CN 1241711 A 1/2000

(Continued)

OTHER PUBLICATIONS

International Search Report for Application No. PCT/CN2017/089096 dated Nov. 1, 2017.

(Continued)

*Primary Examiner* — Robert E Fuller

(74) *Attorney, Agent, or Firm* — Young Basile Hanlon & MacFarlane, P.C.

(57) ABSTRACT

A plugging and wall reinforcing device and a method of using thereof. The nesting plugging and wall reinforcing device comprises an external slotted metal pipe and an internal nested blasting tool, wherein the slotted metal pipe has spiral slits or straight slits cut on a pipe wall thereof; the nested blasting tool is a mandrel having a surface provided with a plurality of explosive grooves in which explosives are placed; the slotted metal pipe is disposed around the mandrel, with a movable fit therebetween. The present invention can effectively improve the plugging success rate.

14 Claims, 10 Drawing Sheets

(56) References Cited

FOREIGN PATENT DOCUMENTS

| | | | |
|---|---|---|---|
| CN | 101270634 | A | 9/2008 |
| CN | 201502356 | U | 6/2010 |
| CN | 102121361 | A | 7/2011 |
| CN | 202630821 | U | 12/2012 |
| CN | 105043180 | A | 11/2015 |
| CN | 205605162 | U | 9/2016 |
| KR | 20100137678 | A | 12/2010 |
| WO | 2013/170294 | A1 | 11/2013 |

OTHER PUBLICATIONS

Chinese Office Action and Search Report for Application No. 201710081098.1 dated Aug. 10, 2018.

Chen Xiaoqiang et al. The Fifth China International Salvage BBS Proceedings, Research on Underwater Plugging and Repairing Technology, pp. 260-261.

* cited by examiner

ENERGY-GATHERED BUNDLE TYPE NESTING PLUGGING AND WALL REINFORCING DEVICE AND APPLICATION THEREOF IN KARST CAVE PLUGGING

CROSS-REFERENCE TO RELATED APPLICATIONS

This application is a continuation of International Application No. PCT/CN2017/089096, filed on Jun. 20, 2017, which claims priority to Chinese Patent Application No. 201710081098.1, filed on Feb. 15, 2017, both of which are hereby incorporated by reference in their entireties.

TECHNICAL FIELD

The present invention relates to an energy-gathered bundle type nesting plugging and wall reinforcing device and an application thereof in karst cave plugging, and belongs to the technical field of downhole constructions.

BACKGROUND ART

Well leakage often occurs during the drilling and completion of the oil and gas wells in the carbonate formations. A slight leakage will interrupt the drilling work, and a serious leakage will delay a lot of production time and cost a plenty of manpower and material resources. If the well leak is not treated in time, it will also cause accidents such as well collapse, blowout and drilling tool jamming, which lead to the scrapping of some well sections and even the whole well, and the serious blowout may also cause personal injury or death, so it is very important to deal with the well leakage and restore the normal drilling in time. At present, there have been mature plugging processes and technologies in China for osmotic- and fracture-type leakages. However, the karst cave-type leakage is an international problem, and any effective solution is still not found in the industry.

Currently, there are dozens of commonly used plugging technologies for the fracture-type leakage, mainly including the pressure-bearing plugging technology, the drilling while plugging technology, the plastic plugging technology, the expansion pipe plugging technology, the gas drilling technology and the cementing plugging technology. The first technology is suitable for plugging the deep wells and the vicious low pressure absorption wells. The second technology is a method of actively causing a leakage and automatically stopping the leakage, which is suitable for formations with low pressure bearing capacities such as complex structural formation and fracture-development formation. The third technology causes plugging slurry to be "weightless" through the interaction between the preparations, and makes the driving force disappear, thereby solving the problem of well leakage, wherein the plugging slurry has the characteristics of plastic creep, adjustable density, durability, etc. The fourth technology is the expansion pipe plugging technology; the effect is obvious once the plugging is successful, and multiple complex layers of the same open hole section can be sealed for multiple times; but this technology requires reaming the drilled wellbore, and as known to the on-site construction personnel, the reaming is of high difficulty, low speed and high-risk, and the broken debris cannot be brought to the ground due to the leakage, which is also the reason why the expansion pipe plugging technology is not widely applied. The fifth technology is the gas drilling, which has can obviously prevent the leakage, while improving the rate of penetration and the wellbore quality and saving the drilling cost; however, the gas drilling cannot be carried out when the formation produces water or in an easily collapsed formation. The sixth technology is the cementing plugging.

These six conventional plugging technologies (traditional physical plugging technologies and chemical plugging technologies) have almost no effect on the karst cave leakage, and it is only effective by plugging after bridging by filling a large amount of solids and long-fiber materials into the well. But such a construction needs to be repeated, and the effect is poor, the time is long, the success rate is low, the cost is high, and the risk of blowout is high during the process; even if the plugging is barely successful, the leakage can be easily caused again in subsequent drilling.

SUMMARY OF THE INVENTION

Based on the analyses of the downhole conditions and various tools, the present invention provides an energy-gathered bundle type nesting plugging and wall reinforcing device and an application thereof in karst cave plugging, for a novel downhole explosion plugging tool and an application thereof for a karst cave-type leakage, thereby solving the difficulty that the plugging material cannot easily reside to form a bridge in the conventional plugging methods, and effectively improving the plugging success rate for the karst cave formation.

The objective of the present invention is achieved in the following technical solutions:

The present invention provides an energy-gathered bundle type nesting plugging and wall reinforcing device, comprising an external slotted metal pipe and an internal nesting blasting tool, wherein the slotted metal pipe has spiral slits or straight slits cut on a pipe wall thereof; the nesting blasting tool is a mandrel (i.e., a shooting pole) having a surface provided with a plurality of explosive grooves in which explosives are placed; the slotted metal pipe is disposed to sleeve the mandrel and fixed, with a movable fit therebetween.

The present invention further provides an application of an energy-gathered bundle type nesting plugging and wall reinforcing device in karst cave plugging, comprising the steps of:

1) if an external slotted metal pipe is single-layered, requiring a length of the metal pipe to be 400 mm longer than a longitudinal length of a karst cave;

if the external slotted metal pipe is double-layered, selecting two metal pipes of different sizes, a wall thickness of each of the metal pipes varying with different metal materials; an inner diameter of an outer layered metal pipe is equal to an outer diameter of an inner layered metal pipe, an outer diameter of the outer layered metal pipe is 5 mm to 10 mm smaller than a diameter of a drill bit for drilling a plugged well section, and the two metal pipes have a same length that is 400 mm longer than a longitudinal length of the karst cave;

2) for the single-layered slotted metal pipe, cutting a plurality of straight slits or spiral slits on a pipe wall of the metal pipe on the ground, and leaving an upper end and a lower end of the metal pipe for 30 mm to 200 mm without cutting, thereby obtaining the single-layered slotted metal pipe;

for the double-layered slotted metal pipe, cutting spiral strips with different left and right turning directions on two metal pipes on the ground respectively, widths of the spiral strips being 10 mm to 50 mm; leaving an upper end and a lower end of each of the two metal pipes for 30 mm to 200 mm without cutting, thereby obtaining the double-layered slotted metal pipe;

or, cutting a plurality of straight slits on a pipe wall of each of the two metal pipes, a straight slit spacing on the inner layered metal pipe is different from a straight slit spacing on the outer layered metal pipe; also, leaving an upper end and a lower end of each of the two metal pipes for 30 mm to 200 mm without cutting, thereby obtaining the double-layered slotted metal pipe;

3) connecting a mandrel having a plurality of explosive grooves below a downhole drilling tool, widths of the explosive grooves varying with amounts of explosives placed; if the straight slits are cut on the metal pipe, the explosive grooves of the mandrel are spiral grooves, and if the spiral slits are cut on the metal pipe, the explosive grooves of the mandrel are straight grooves; next, sleeving the mandrel with the slotted metal pipe and fixing the slotted metal pipe, with a movable fit therebetween, and placing explosives in the explosive grooves of the mandrel;

4) delivering the mandrel to the karst cave using the drilling tool to ignite the explosives; by using energy generated by an explosion of the explosives, causing the slotted metal pipe fixed on the mandrel to be plastically deformed and attached to a wall of the karst cave, the upper end and the lower end of the slotted metal pipe respectively abutting against an upper plate and a lower plate of the karst cave to complete a nesting operation; next, injecting a long fiber material or a plugging glue to form an artificial well wall, thereby ensuring that the drilling can pass through a plurality of meters of karst cave safely, efficiently and quickly.

Although the expansion pipe can also be exploded for plugging, there are three problems: 1. the amount of explosives is large, about 2 kg of explosives per meter; 2. the expansion pipe is made of a flexible alloy material with a high strength, so it is difficult for the drill bit to trim the part protruding from well wall; 3. the expansion pipe has no drain passage, and in the process of explosion and deformation, a huge impact force is applied to the liquid in the annular space, which causes instability of the well wall and hinders the deformation of the expansion pipe.

In conclusion, with the energy-gathered bundle type nesting plugging and wall reinforcing device and the application thereof (new technology and new tool) developed by the present invention, which are suitable for the downhole small-scale karst cave (the length of the section is not more than 8 m) leakage, a bridge can be formed after the explosion of the slotted metal pipe (the slotted metal pipe can be impacted into a bird nest shape after the detonation), which solves the difficulty that the plugging material cannot easily enter the formation in the conventional plugging method, and effectively improves the plugging success rate for the karst cave formation. Such a high-efficiency and low-cost plugging construction will help to increase the exploitation proportion of natural gas in the carbonate formations in the Tarim Basin, the Sichuan Basin in Southwest China, and the Songliao Basin in Northeast China, and have great significances for China to successfully implement the green low-carbon strategy, optimize the energy structure, ensure the energy security, and maintain the sustainable economic and social development.

The present invention not only has important significances for plugging in the drilling of the karst cave formation, but also has certain reference values for the mine plugging and the tunneling plugging.

DETAILED DESCRIPTION OF THE PREFERRED EMBODIMENTS

Embodiment 1 (Single-Layered Straight Slotted Metal Pipe)

Figure 3:
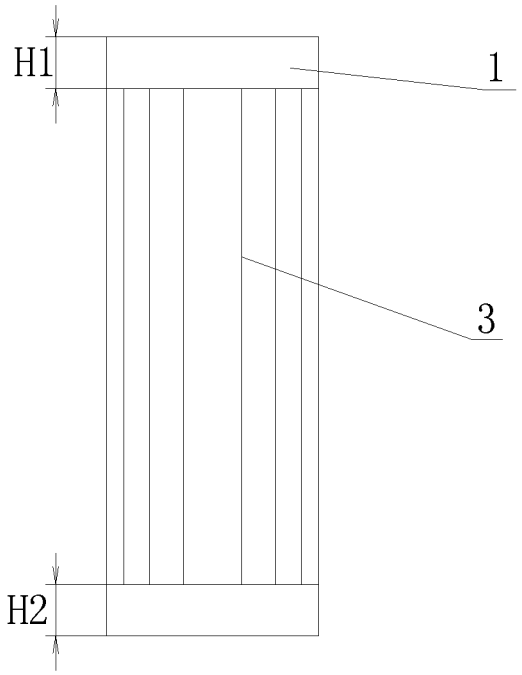
FIG. 3 is a schematic structural diagram of a single-layered straight slotted metal pipe in the present invention.
Figure 8:
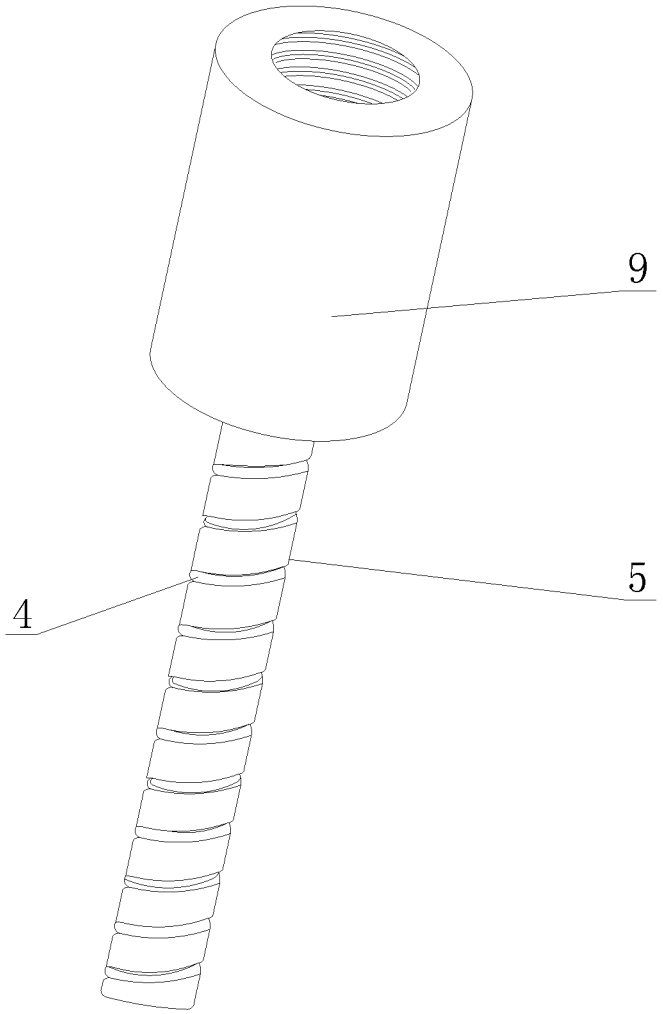
FIG. 8 illustrates a mandrel in which explosive grooves are spiral groove in the present invention.

An energy-gathered bundle type nesting plugging and wall reinforcing device, comprising an external slotted metal pipe 1 and an internal nesting blasting tool, wherein the slotted metal pipe 1 is single-layered and having a plurality of straight slits 3 cut on a pipe wall thereof (as shown in FIG. 3); the nesting blasting tool is a mandrel 5 having a surface provided with a plurality of explosive grooves 4 which are spiral grooves (as shown in FIG. 8), and in which explosives are placed; the slotted metal pipe 1 is disposed to sleeve the mandrel 5 and fixed, with a movable fit therebetween. A distance H1 from a head end of the straight slit 3 to a top end of the slotted metal pipe 1 is 30 mm to 200 mm, and a distance H2 from a tail end of the straight slit 3 to a tail end of the slotted metal pipe 1 is 30 mm to 200 mm.

Figure 4:
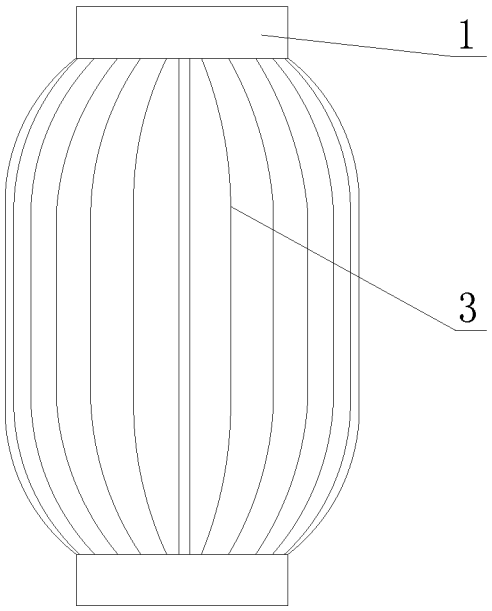
FIG. 4 is a schematic structural diagram of the metal pipe in FIG. 3 after an explosion.

An application of the energy-gathered bundle type nesting plugging and wall reinforcing device in karst cave plugging comprises the steps of:

1) the external slotted metal pipe 1 being single-layered, a length of the metal pipe being required to be 400 mm longer than a longitudinal length of a karst cave 8, and a wall thickness of the metal pipe varying depending on different metal materials;
2) for the single-layered slotted metal pipe 1, cutting a plurality of straight slits 3 on a pipe wall of the metal pipe on the ground, and leaving an upper end and a lower end of the metal pipe for 30 mm to 200 mm without cutting, thereby obtaining the single-layered slotted metal pipe 1;
3) connecting a mandrel 5 having a plurality of explosive grooves 4 below a downhole drilling tool through a tool joint 9, widths of the explosive grooves 4 varying with amounts of explosives placed, and the explosive grooves 4 of the mandrel 5 being spiral grooves; next, sleeving the mandrel 5 with the slotted metal pipe 1 and fixing the slotted metal pipe 1, with a movable fit therebetween, and placing explosives in the explosive grooves 4 of the mandrel 5;
4) delivering the mandrel 5 to the karst cave 8 using the drilling tool to ignite the explosives, as shown in FIG. 4, and by using energy generated by an explosion of the explosives, causing the slotted metal pipe 1 fixed on the mandrel 5 to be plastically deformed and attached to a wall of the karst cave, and shortening a length of the slotted metal pipe 1; at that time, the upper end and the lower end of the slotted metal pipe 1 respectively abut against an upper plate and a lower plate of the karst cave 8 to complete a nesting operation; next, injecting a long fiber material or a plugging glue into the plurality of straight slits 3 of the slotted metal pipe 1 to form an artificial well wall, thereby ensuring that the drilling can pass through a plurality of meters of karst cave safely, efficiently and quickly.

Embodiment 2 (Single-Layered Spiral Slotted Metal Pipe)

Figure 1:
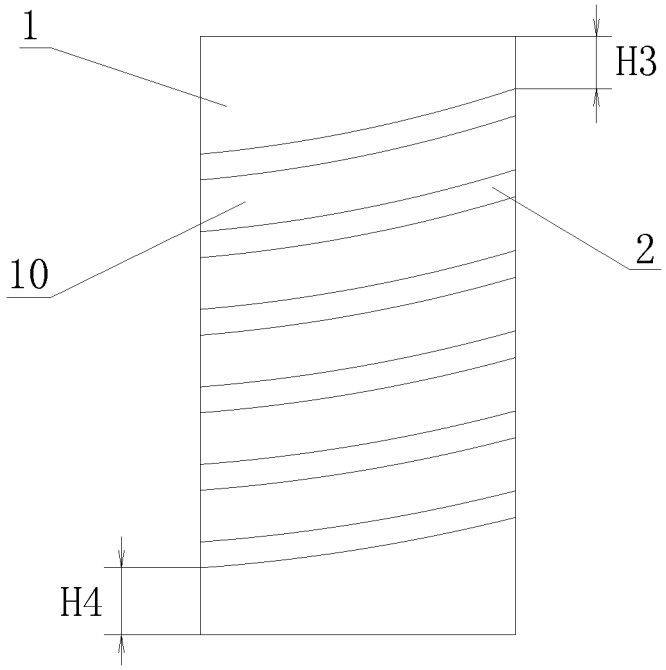
FIG. 1 is a schematic structural diagram of a single-layered spiral slotted metal pipe in the present invention.
Figure 7:
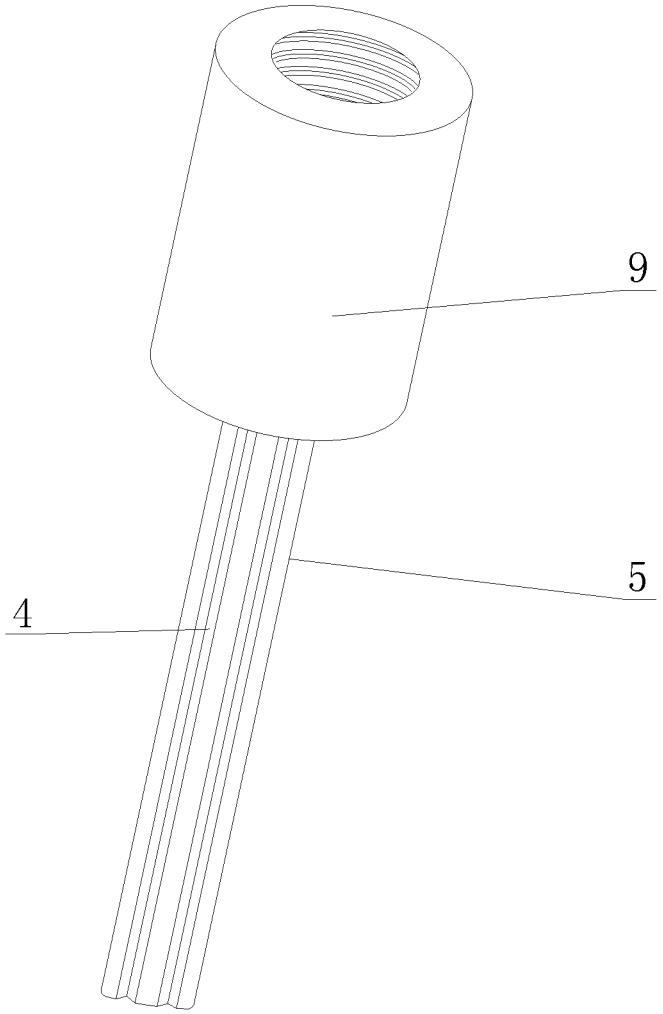
FIG. 7 illustrates a mandrel in which explosive grooves are straight grooves in the present invention.

An energy-gathered bundle type nesting plugging and wall reinforcing device, comprising an external slotted metal pipe 1 and an internal nesting blasting tool, wherein the slotted metal pipe 1 has a plurality of spiral slits 2 cut on a pipe wall thereof (as shown in FIG. 1), and a spiral strip 10 is formed between two adjacent spiral slits 2; the nesting blasting tool is a mandrel 5 having a surface provided with a plurality of explosive grooves 4 which are straight grooves (as shown in FIG. 7), and in which explosives are placed; the slotted metal pipe 1 is disposed to sleeve the mandrel 5 and fixed, with a movable fit therebetween. A distance H3 from a head end of the spiral slit 2 to a top end of the slotted metal pipe 1 is 30 mm to 200 mm, and a distance H4 from a tail end of the spiral slit 2 to a tail end of the slotted metal pipe 1 is 30 mm to 200 mm.

Figure 2:
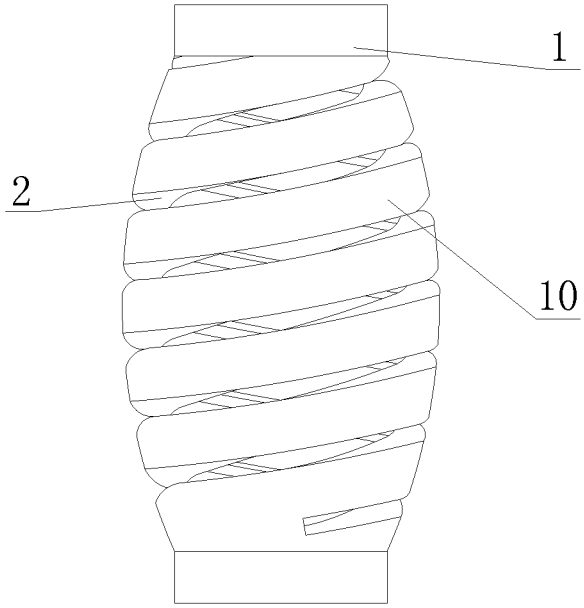
FIG. 2 is a schematic structural diagram of the metal pipe in FIG. 1 after an explosion.

An application of the energy-gathered bundle type nesting plugging and wall reinforcing device in karst cave plugging comprises the steps of:

1) the external slotted metal pipe 1 being single-layered, a length of the metal pipe being required to be 400 mm longer than a longitudinal length of a karst cave 8, and a wall thickness of the metal pipe varying depending on different metal materials;
2) for the single-layered slotted metal pipe 1, cutting a plurality of spiral slits 2 on a pipe wall of the metal pipe on the ground, and leaving an upper end and a lower end of the metal pipe for 30 mm to 200 mm without cutting, thereby obtaining the single-layered slotted metal pipe 1;
3) connecting a mandrel 5 having a plurality of explosive grooves 4 below a downhole drilling tool through a tool joint 9, widths of the explosive grooves 4 varying with amounts of explosives placed, and the explosive grooves 4 of the mandrel 5 being straight grooves; next, sleeving the mandrel 5 with the slotted metal pipe 1 and fixing the slotted metal pipe 1, with a movable fit therebetween, and placing explosives in the explosive grooves 4 of the mandrel 5;
4) delivering the mandrel 5 to the karst cave 8 using the drilling tool to ignite the explosives, as shown in FIG. 2, and by using energy generated by an explosion of the explosives, causing the slotted metal pipe 1 fixed on the mandrel 5 to be plastically deformed and attached to a wall of the karst cave, and shortening a length of the slotted metal pipe 1; at that time, the upper end and the lower end of the slotted metal pipe 1 respectively abut against an upper plate and a lower plate of the karst cave 8 to complete a nesting operation; next, injecting a long fiber material or a plugging glue into the plurality of spiral slits 2 of the slotted metal pipe 1 to form an artificial well wall, thereby ensuring that the drilling can pass through a plurality of meters of karst cave safely, efficiently and quickly.

Embodiment 3 (Double-Layered Straight Slotted Metal Pipe)

An energy-gathered bundle type nesting plugging and wall reinforcing device, comprising an external slotted metal pipe 1' and an internal nesting blasting tool, wherein the nesting blasting tool is a mandrel 5 having a surface provided with a plurality of explosive grooves 4 which are spiral grooves (as shown in FIG. 8), and in which explosives are placed; the slotted metal pipe 1' is disposed to sleeve the mandrel 5 and fixed, with a movable fit therebetween.

Figure 10:
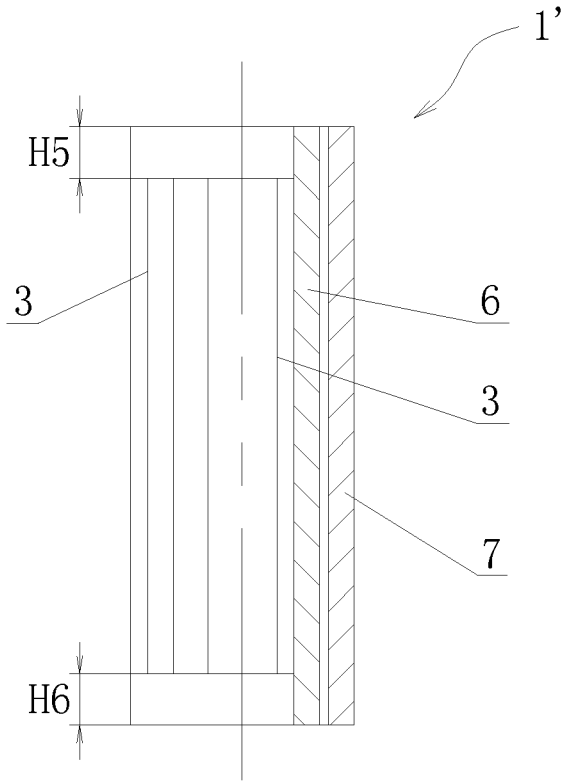
FIG. 10 is a schematic structural diagram of a double-layered straight slotted metal pipe in the present invention.

The slotted metal pipe 1' is double-layered (as shown in FIG. 10), comprising an inner layered slotted metal pipe 6 and an outer layered slotted metal pipe 7, which have a same length that is 400 mm longer than a longitudinal length of a karst cave 8.

An outer diameter of the inner layered slotted metal pipe 6 is equal to an inner diameter of the outer layered slotted metal pipe 7, and an outer diameter of the outer layered slotted metal pipe 7 is 5 mm to 10 mm smaller than a diameter of a well wall of a plugged well section.

The pipe wall of the inner layered slotted metal pipe 6 and the pipe wall of the outer layered slotted metal pipe 7 are each provided with a plurality of straight slits 3, and a straight slit spacing on the inner layered slotted metal pipe 6 is different from a straight slit spacing on the outer layered slotted metal pipe 7; a distance H5 from a head end of the straight slit 3 to a top end of corresponding slotted metal pipe (i.e., the inner layered slotted metal pipe 6 or the outer layered slotted metal pipe 7) is 30 mm to 200 mm, and a distance H6 from a tail end of the straight slit 3 to a tail end of corresponding slotted metal pipe (i.e., the inner layered slotted metal pipe 6 or the outer layered slotted metal pipe 7) is 30 mm to 200 mm.

Figure 9:
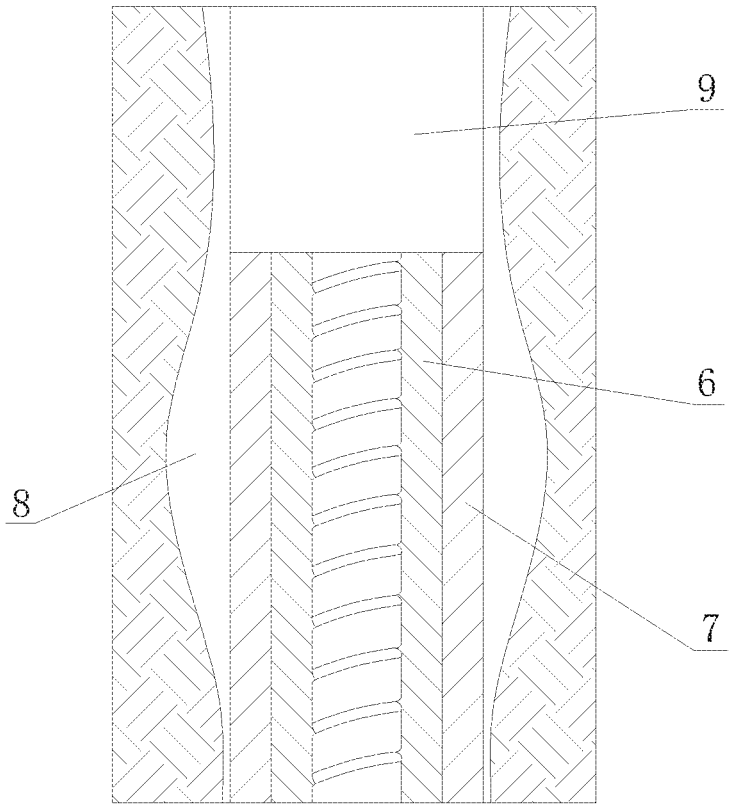
FIG. 9 is a schematic structural diagram of a double-layered spiral slotted metal pipe applied for karst cave plugging.

As shown in FIG. 9, an application of the energy-gathered bundle type nesting plugging and wall reinforcing device in karst cave plugging comprises the steps of:

1) selecting two metal pipes of different sizes, a wall thickness of each of the metal pipes varying with different metal materials; an inner diameter of the outer layered slotted metal pipe 7 is equal to an outer diameter of the inner layered slotted metal pipe 6, an outer diameter of the outer layered slotted metal pipe 7 is 5 mm to 10 mm smaller than a diameter of a drill bit for drilling a plugged well section, and the two metal pipes (i.e., the inner layered slotted metal pipe 6 and the outer layered slotted metal pipe 7) have a same length that is 400 mm longer than a longitudinal length of a karst cave 8;
2) cutting a plurality of straight slits 3 on a pipe wall of each of the two metal pipes (i.e., the inner layered slotted metal pipe 6 and the outer layered slotted metal pipe 7); a straight slit spacing on the inner layered slotted metal pipe 6 is different from a straight slit spacing on the outer layered slotted metal pipe 7; also, leaving an upper end and a lower end of each of the two metal pipes (i.e., the inner layered slotted metal pipe 6 and the outer layered slotted metal pipe 7) for 30 mm to 200 mm without cutting, thereby obtaining the double-layered slotted metal pipe 1';
3) connecting a mandrel 5 having a plurality of explosive grooves 4 below a downhole drilling tool through a tool joint 9, widths of the explosive grooves 4 varying with amounts of explosives placed, and the explosive grooves 4 of the mandrel 5 being spiral grooves; next, sleeving the mandrel 5 with the slotted metal pipe 1' and fixing the slotted metal pipe 1', with a movable fit therebetween, and placing explosives in the explosive grooves 4 of the mandrel 5;

4) delivering the mandrel 5 to the karst cave 8 using the drilling tool to ignite the explosives; by using energy generated by an explosion of the explosives, causing the slotted metal pipe 1' fixed on the mandrel 5 to be plastically deformed and attached to a wall of the karst cave, and shortening a length of the slotted metal pipe 1'; at that time, the upper end and the lower end of the slotted metal pipe 1' respectively abut against an upper plate and a lower plate of the karst cave 8 to complete a nesting operation; next, injecting a long fiber material or a plugging glue into the plurality of straight slits 3 of the slotted metal pipe 1' to form an artificial well wall, thereby ensuring that the drilling can pass through a plurality of meters of karst cave safely, efficiently and quickly.

Embodiment 4 (Double-Layered Spiral Slotted Metal Pipe)

An energy-gathered bundle type nesting plugging and wall reinforcing device, comprising an external slotted metal pipe 1' and an internal nesting blasting tool, wherein the slotted metal pipe 1' has a plurality of spiral slits 2 cut on a pipe wall thereof; as shown in FIG. 7, the nesting blasting tool is a mandrel 5 having a surface provided with a plurality of explosive grooves 4 which are straight grooves and in which explosives are placed; the slotted metal pipe 1' is disposed to sleeve the mandrel 5 and fixed, with a movable fit therebetween.

Figure 5:
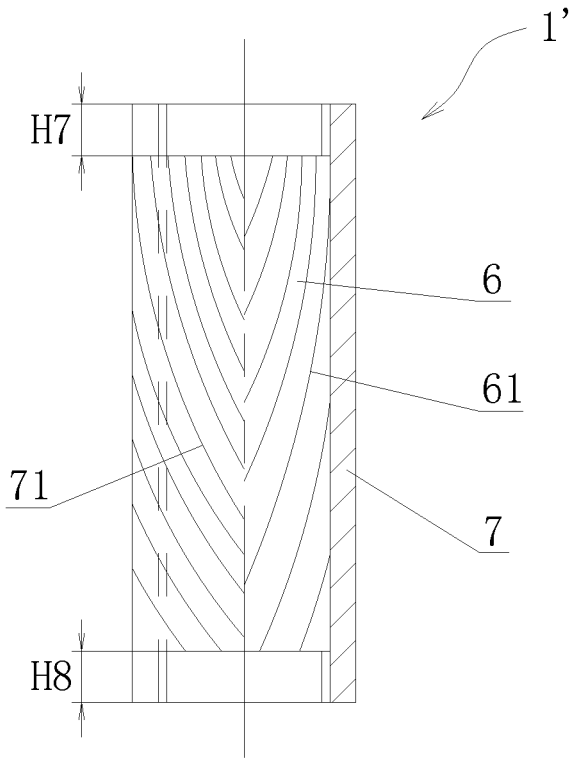
FIG. 5 is a schematic structural diagram of a double-layered spiral slotted metal pipe in the present invention.

As shown in FIG. 5, the slotted metal pipe 1' is double-layered, comprising an inner layered slotted metal pipe 6 and an outer layered slotted metal pipe 7, which have a same length that is 400 mm longer than a longitudinal length of a karst cave 8. An outer diameter of the inner layered slotted metal pipe 6 is equal to an inner diameter of the outer layered slotted metal pipe 7, and an outer diameter of the outer layered slotted metal pipe 7 is 5 mm to 10 mm smaller than a diameter of a drill bit for drilling a plugged well section.

The pipe wall of the inner layered slotted metal pipe 6 is provided with a plurality of first spiral slits 61, which are left spiral slits or right spiral slits, and the pipe wall of the outer layered slotted metal pipe 7 is provided with a plurality of second spiral slits 71, a turning direction of which is opposite to that of the first spiral slits 61 of the inner layered slotted metal pipe 6; a distance between two adjacent spiral slits of the inner layered slotted metal pipe 6 or the outer layered slotted metal pipe 7 (i.e., two adjacent first spiral slits 61 or two adjacent second spiral slits 71) is 10 mm to 50 mm; a distance H7 from a head end of the spiral slit to a top end of corresponding slotted metal pipe is 30 mm to 200 mm (i.e., a distance from a head end of the first spiral slit 61 of the inner layered slotted metal pipe 6 to a top end of the inner layered slotted metal pipe 6 is 30 mm to 200 mm, and a distance from a head end of the second spiral slit 71 of the outer layered slotted metal pipe 7 to a top end of the outer layered slotted metal pipe 7 is 30 mm to 200 mm); similarly, a distance H8 from a tail end of the spiral slit to a tail end of corresponding slotted metal pipe is 30 mm to 200 mm (i.e., a distance from a tail end of the first spiral slit 61 of the inner layered slotted metal pipe 6 to a tail end of the inner layered slotted metal pipe 6 is 30 mm to 200 mm, and a distance from a tail end of the second spiral slit 71 of the outer layered slotted metal pipe 7 to a tail end of the outer layered slotted metal pipe 7 is 30 mm to 200 mm).

Figure 6:
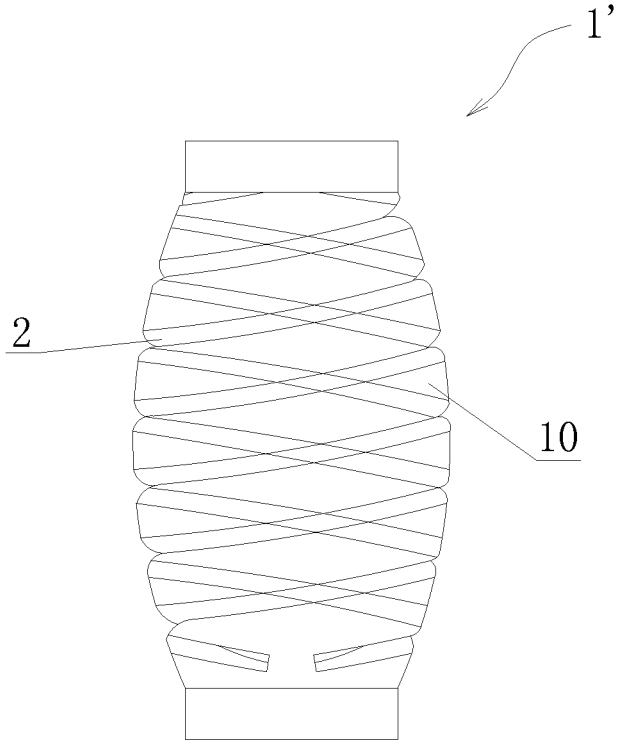
FIG. 6 is a schematic structural diagram of the metal pipe in FIG. 5 after an explosion.

An application of the energy-gathered bundle type nesting plugging and wall reinforcing device in karst cave plugging comprises the steps of:

1) selecting two metal pipes of different sizes, a wall thickness of each of the metal pipes varying with different metal materials; an inner diameter of the outer layered metal pipe is equal to an outer diameter of the inner layered metal pipe, an outer diameter of the outer layered metal pipe is 5 mm to 10 mm smaller than a diameter of a drill bit for drilling a plugged well section, and the two metal pipes have a same length that is 400 mm longer than a longitudinal length of a karst cave 8;

2) cutting spiral strips 10 with different left and right turning directions on the two metal pipes on the ground respectively, widths of the spiral strips 10 being 10 mm to 50 mm; leaving an upper end and a lower end of each of the two metal pipes for 30 mm to 200 mm without cutting, thereby obtaining the double-layered slotted metal pipe 1';

3) connecting a mandrel 5 having a plurality of explosive grooves 4 below a downhole drilling tool through a tool joint 9, widths of the explosive grooves 4 varying with amounts of explosives placed, and the explosive grooves 4 of the mandrel 5 being straight grooves; next, sleeving the mandrel 5 with the slotted metal pipe 1' and fixing the slotted metal pipe 1', with a movable fit therebetween, and placing explosives in the explosive grooves 4 of the mandrel 5;

4) delivering the mandrel 5 to the karst cave 8 using the drilling tool to ignite the explosives; as shown in FIG. 6, by using energy generated by an explosion of the explosives, causing the slotted metal pipe 1' fixed on the mandrel 5 to be plastically deformed and attached to a wall of the karst cave, and shortening a length of the slotted metal pipe 1'; at that time, the upper end and the lower end of the slotted metal pipe 1' respectively abut against an upper plate and a lower plate of the karst cave 8 to complete a nesting operation; next, injecting a long fiber material or a plugging glue into the plurality of spiral slits (i.e., the first spiral slits 61 and the second spiral slits 71) of the slotted metal pipe 1' to form an artificial well wall, thereby ensuring that the drilling can pass through a plurality of meters of karst cave safely, efficiently and quickly.

In the above embodiments of the present invention, a movable fit is adopted between the mandrel 5 and the slotted metal pipe 1 or the slotted metal pipe 1', and the movable fit is the clearance fit commonly described in the field of mechanical designs. In the present invention, the mandrel 5 may be connected to the slotted metal pipe 1 or the slotted metal pipe 1' by means of a threaded connection.

In the above embodiments of the present invention, the long fiber material may be, for example, acetate fiber, wood fiber, cotton fiber, bamboo fiber, plant straws or cotton seed shells with cotton fiber. In addition, the plugging glue may be, for example, cross-linked polymer gel.

Finally, it should be noted that the above embodiments are only used to illustrate, rather than limiting, the technical solutions of the present invention. Although the present invention is described in detail with reference to the preferred embodiments, those skilled in the art should understand that any modification or equivalent replacement may be made for the technical solutions of the present invention, without deviating from the spirit and scope of the technical solutions of the present invention, and those modifications or equivalent replacements should fall within the scope of the claims of the present invention.

What is claimed is:

1. A plugging and wall reinforcing device, comprising an external slotted metal pipe and an internal nested blasting tool, wherein the slotted metal pipe has spiral slits or straight slits cut on a pipe wall thereof; the nested blasting tool is a mandrel having a surface provided with a plurality of explosive grooves in which explosives are placed; the slotted metal pipe is disposed around the mandrel, with a movable fit therebetween.

2. The plugging and wall reinforcing device according to claim 1, wherein the slotted metal pipe is double-layered, comprising an inner slotted metal pipe and an outer slotted metal pipe, which have a same length that is 400 mm longer than a longitudinal length of a karst cave.

3. The plugging and wall reinforcing device according to claim 2, wherein an outer diameter of the inner slotted metal pipe is equal to an inner diameter of the outer slotted metal pipe, and an outer diameter of the outer slotted metal pipe is 5 mm to 10 mm smaller than a diameter of a drill bit for drilling a plugged well section.

4. The plugging and wall reinforcing device according to claim 3, wherein a pipe wall of the inner slotted metal pipe is provided with a plurality of first spiral slits, which are left spiral slits or right spiral slits; and a pipe wall of the outer slotted metal pipe is provided with a plurality of second spiral slits, a turning direction of which is opposite to that of the first spiral slits;

a distance between two adjacent first spiral slits of the inner slotted metal pipe is 10 mm to 50 mm; and a distance between two adjacent second spiral slits of the outer slotted metal pipe is 10 mm to 50 mm;

a distance from a head end of the first spiral slit to a top end of the inner slotted metal pipe is 30 mm to 200 mm, and a distance from a head end of the second spiral slit to a top end of the outer slotted metal pipe is 30 mm to 200 mm; a distance from a tail end of the first spiral slit to a tail end of the inner slotted metal pipe is 30 mm to 200 mm, and a distance from a tail end of the second spiral slit to a tail end of the outer slotted metal pipe is 30 mm to 200 mm.

5. The plugging and wall reinforcing device according to claim 4, wherein the explosive grooves of the mandrel are straight grooves.

6. The plugging and wall reinforcing device according to claim 3, wherein a pipe wall of the inner slotted metal pipe and a pipe wall of the outer slotted metal pipe are each provided with a plurality of straight slits, and a straight slit spacing on the inner slotted metal pipe is different from a straight slit spacing on the outer slotted metal pipe;

a distance from a head end of the straight slit of the inner slotted metal pipe to a top end of the inner slotted metal pipe is 30 mm to 200 mm, and a distance from a head end of the straight slit of the outer slotted metal pipe to a top end of the outer slotted metal pipe is 30 mm to 200 mm; a distance from a tail end of the straight slit of the inner slotted metal pipe to a tail end of the inner slotted metal pipe is 30 mm to 200 mm, and a distance from a tail end of the straight slit of the outer slotted metal pipe to a tail end of the outer slotted metal pipe is 30 mm to 200 mm.

7. The plugging and wall reinforcing device according to claim 6, wherein the explosive grooves of the mandrel are spiral grooves.

8. The plugging and wall reinforcing device according to claim 2, wherein a pipe wall of the inner slotted metal pipe is provided with a plurality of first spiral slits, which are left spiral slits or right spiral slits; and a pipe wall of the outer slotted metal pipe is provided with a plurality of second spiral slits, a turning direction of which is opposite to that of the first spiral slits;

a distance between two adjacent first spiral slits of the inner slotted metal pipe is 10 mm to 50 mm; and a distance between two adjacent second spiral slits of the outer slotted metal pipe is 10 mm to 50 mm;

a distance from a head end of the first spiral slit to a top end of the inner slotted metal pipe is 30 mm to 200 mm, and a distance from a head end of the second spiral slit to a top end of the outer slotted metal pipe is 30 mm to 200 mm; a distance from a tail end of the first spiral slit to a tail end of the inner slotted metal pipe is 30 mm to 200 mm, and a distance from a tail end of the second spiral slit to a tail end of the outer slotted metal pipe is 30 mm to 200 mm.

9. The plugging and wall reinforcing device according to claim 8, wherein the explosive grooves of the mandrel are straight grooves.

10. The plugging and wall reinforcing device according to claim 2, wherein a pipe wall of the inner slotted metal pipe and a pipe wall of the outer slotted metal pipe are each provided with a plurality of straight slits, and a straight slit spacing on the inner slotted metal pipe is different from a straight slit spacing on the outer slotted metal pipe;

a distance from a head end of the straight slit of the inner slotted metal pipe to a top end of the inner slotted metal pipe is 30 mm to 200 mm, and a distance from a head end of the straight slit of the outer slotted metal pipe to a top end of the outer slotted metal pipe is 30 mm to 200 mm; a distance from a tail end of the straight slit of the inner slotted metal pipe to a tail end of the inner slotted metal pipe is 30 mm to 200 mm, and a distance from a tail end of the straight slit of the outer slotted metal pipe to a tail end of the outer slotted metal pipe is 30 mm to 200 mm.

11. The plugging and wall reinforcing device according to claim 10, wherein the explosive grooves of the mandrel are spiral grooves.

12. The plugging and wall reinforcing device according to claim 1, wherein the slotted metal pipe is single-layered, a distance from a head end of the spiral slit or the straight slit to a top end of the slotted metal pipe is 30 mm to 200 mm, and a distance from a tail end of the spiral slit or the straight slit to a tail end of the slotted metal pipe is 30 mm to 200 mm.

13. The plugging and wall reinforcing device according to claim 12, wherein the slotted metal pipe is provided with the spiral slits, and the explosive grooves of the mandrel are straight grooves; or the slotted metal pipe is provided with the straight slits, and the explosive grooves of the mandrel are spiral grooves.

14. A method of using a plugging and wall reinforcing device, comprising the steps of:

drilling a borehole which intersects a karst cave, said karst cave having an upper plate and a lower plate;

1) if an external slotted metal pipe is single-layered, forming a length of the metal pipe to be 400 mm longer than a longitudinal length of a karst cave;

if the external slotted metal pipe is double-layered, selecting two metal pipes of different sizes, a wall thickness of each of the metal pipes varying with different metal materials; an inner diameter of an outer layered metal pipe is equal to an outer diameter of an inner layered metal pipe, an outer diameter of the outer layered metal pipe is 5 mm to 10 mm smaller than a diameter of a drill bit for drilling a plugged well section, and the two metal pipes have a same length that is 400 mm longer than the longitudinal length of the karst cave;

2) for the single-layered slotted metal pipe, cutting a plurality of straight slits or spiral slits on a pipe wall of the metal pipe on the ground, and leaving an upper end and a lower end of the metal pipe for 30 mm to 200 mm without cutting, thereby obtaining the single-layered slotted metal pipe;

for the double-layered slotted metal pipe, cutting spiral strips with different left and right turning directions on two metal pipes on the ground respectively, widths of the spiral strips being 10 mm to 50 mm; leaving an upper end and a lower end of each of the two metal pipes for 30 mm to 200 mm without cutting, thereby obtaining the double-layered slotted metal pipe; or, cutting a plurality of straight slits on a pipe wall of each of the two metal pipes, a straight slit spacing on the inner layered metal pipe is different from a straight slit spacing on the outer layered metal pipe; also, leaving an upper end and a lower end of each of the two metal pipes for 30 mm to 200 mm without cutting, thereby obtaining the double-layered slotted metal pipe;

3) supplying a mandrel with a plurality of explosive grooves, wherein widths of the explosive grooves vary with amounts of explosives placed; if the straight slits are cut on the metal pipe, the explosive grooves of the mandrel are spiral grooves, and if the spiral slits are cut on the metal pipe, the explosive grooves of the mandrel are straight grooves; next, sleeving the mandrel with the slotted metal pipe and fixing the slotted metal pipe, with a movable fit therebetween, and placing explosives in the explosive grooves of the mandrel;

4) delivering the mandrel to the karst cave, and igniting the explosives; by using energy generated by an explosion of the explosives, causing the slotted metal pipe fixed on the mandrel to be plastically deformed and attached to a wall of the karst cave, the upper end and the lower end of the slotted metal pipe respectively abutting against an upper plate and a lower plate of the karst cave to complete a wall reinforcing operation;

next, injecting a long fiber material or a plugging glue to form an artificial well wall, thereby isolating the borehole from the karst cave.

* * * * *